United States Patent [19]

Glaser et al.

[11] Patent Number: 4,790,136

[45] Date of Patent: Dec. 13, 1988

[54] METHOD AND APPARATUS FOR THE MANUFACTURE OF GLASS FIBER STRAND ROVING

[75] Inventors: Hellmut I. Glaser; William L. Streicher, both of Granville, Ohio

[73] Assignee: Owens-Corning Fiberglas Corporation, Toledo, Ohio

[21] Appl. No.: 109,671

[22] Filed: Oct. 19, 1987

[51] Int. Cl.[4] ..... D01H 7/00; D02G 3/18; D02G 3/22; D02J 1/02

[52] U.S. Cl. ..... 57/350; 28/271; 57/2; 57/200; 57/206; 57/208; 57/246; 57/249; 57/333; 57/341

[58] Field of Search ..... 57/1 R, 2, 6, 59, 200, 57/204–208, 333, 334, 341–343, 350, 246, 351, 249; 28/271–276

[56] References Cited

U.S. PATENT DOCUMENTS

| | | | |
|---|---|---|---|
| 2,795,926 | 6/1957 | Drummond | 57/297 X |
| 3,118,213 | 1/1964 | Benson et al. | 57/350 X |
| 3,324,641 | 6/1967 | Benson et al. | 57/350 |
| 4,741,151 | 5/1988 | Klink et al. | 57/350 |

*Primary Examiner*—John Petrakes

*Attorney, Agent, or Firm*—Patrick P. Pacella; Ronald E. Champion; Thomas A. Meehan

[57] ABSTRACT

A glass fiber bulk strand roving that is made up of a multiplicity of strands, each of which is made up of a plurality of individual fibers, for example, 200 of such fibers. Each strand of the roving has a multiplicity of rather long, axially extending loops, for example, axially extending loops with a calculated length of at least 6 inches, and a multiplicity of shorter, unbroken, cross-axially extending loops that are formed in the axially extending loops of such strands. The axially extending loops and the cross-axially extending loops interengage and intertwine with one another for form a composite entangled structure. The roving of the present invention is made by a process that uses a finger wheel to form axially extending loops in strands and a co-axial spinner with an inlet that is positioned above or below the finger wheel. The looped strands from the finger wheel pass through a relatively unrestricted passage in the spinner which imparts a twist to such a looped strand, and then through a relatively restricted outlet orifice that is downstream of the outlet of the spinner. A back-up or puddling of the looped strands occurs in the spinner near the outlet thereof, due to the axial length of the loops in the strands and the restriction in the outlet of the spinner in the form of the outlet orifice, and this back-up or puddling of the looped strands in the spinner, in conjunction with the spinning thereof, results in the formation of the cross-axial loops in the axial loops of the strands. The positions of the finger wheel and the spinner relative to one another are variable to permit variation in the characteristics of the bulk strand roving that is produced thereby.

6 Claims, 2 Drawing Sheets

METHOD AND APPARATUS FOR THE MANUFACTURE OF GLASS FIBER STRAND ROVING

TECHNICAL FIELD

This invention relates to a glass fiber bulk strand roving that is characterized by a relatively large number of unbroken cross-axial loops, in addition to the axial loops that are characteristic of prior art glass fiber rovings, and to a controllable method and apparatus for the manufacture thereof on a high throughput basis.

BACKGROUND ART

As is set forth in co-pending application Ser. No. 044,182 of Jerome P. Klink and Hellmut I. Glaser, filed Apr. 30, 1987 and now U.S. Pat. No. 4,741,151, which is assigned to the assignee of this application, glass fiber spun rovings are known in the prior art and are used as reinforcement materials in various types of thermoplastic products, such as the types of glass fiber reinforced plastic products that are produced by the pultrusion process. Such reinforced thermoplastic products are used, for example, as sucker rods in oil well drilling because of their relatively light weight and good longitudinal direction strength. Most glass fiber spun rovings that have been used as reinforcement materials for such reinforced thermoplastic products have been produced by a process corresponding to that which is described in U.S. Pat. No. 2,795,926 (W. W. Drummond), which is assigned to the assignee of this application. As described in the aforesaid U.S. Pat. No. 2,795,926, a main strand of glass fiber is caused to form multiple loops therein by passing it through a spinner to form a roving-like article, and the roving-like article is then combined with a group of primary filaments into a composite product. This composite product is rather expensive to produce, due partly to the fact that the primary filaments are relatively expensive because of their relatively low bulkiness, and due partly to the fact that the process is awkward and is not readily adaptable to standard production techniques or high throughput bushings.

Due to problems relating to the use of primary filaments and to the awkward nature of the process that was associated with the manufacture of roving-like glass fiber products according to the teachings of the aforesaid U.S. Pat. No. 2,795,926, an alternative spun roving product, and method and apparatus for the manufacture thereof, was developed and U.S. Pat. No. 3,324,641 (G. E. Benson, et al.), also assigned to the assignee of this application, was granted thereon. According to U.S. Pat. No. 3,324,641, a spun roving glass fiber product can be produced without the need for a separate source of supply of primary filaments by passing a strand through a peg wheel spinner to form multiple axially extending loops therein and then through a spinning, frustoconically shaped spinner, from the large end to the small end thereof, to cause the axially extending loops to intertwine and interlock with one another. However, the process of the aforesaid U.S. Pat. No. 3,324,641 was not effective in forming a spun roving glass fiber product with a significant number of cross-axial loops, and did not gain widespread commercial acceptance except in regard to the manufacture of decorative yarn. Further, the process of the aforesaid U.S. Pat. No. 3,324,641 employed an air tucker to direct high velocity air in a annular pattern against the product to enhance the texturizing of the product, which is an important characteristic in a decorative yarn product. However, it has been found that this air tucker frequently results in the fracturing of some of the loops of the product and this is a factor which detracts from the tensile strength of the product. U.S. Pat. No. 3,118,213 (G. E. Bensen et al.) discloses an apparatus for producing a spun roving that uses loop forming fingers within a spinner. However, in the arrangement of this reference, the fingers are attached to the spinner and it is not possible to vary the rotational speed of the fingers relative to the rotational speed of the spinner.

DISCLOSURE OF THE INVENTION

According to the present invention there is provided a glass fiber roving product which has a relatively large number of unbroken cross-axial loops, in addition to the axial loops that are characteristic of prior art spun rovings, and which, as a consequence of the relatively large number of cross-axial loops, has a high bulk factor which results in a high degree of improvement in the properties of a plastic product that is reinforced with such a roving product for a given weight of glass fiber therein. Further, as a consequence of the fact that a relatively large number of the cross-axial loops of the high bulk roving product of this invention are unbroken, a plastic product that is reinforced with such a high bulk roving will have enhanced strength characteristics in the cross-axial direction. The high bulk roving according to the present invention does not need any center strand corresponding to the primary filaments of the roving-like product of the aforesaid U.S. Pat. No. 2,795,926, which, desirably, enhances the bulkiness of the product of this invention for a given weight of glass fibers, and permits the product of this invention to be produced by techniques that are quite compatible with standard production techniques and with high throughput bushings, and, thus, at a very competitive manufacturing cost. The high bulk roving of the present invention is somewhat less entangled than the high bulk roving of the aforesaid U.S. Pat. No. 4,741,151, and it has somewhat more outwardly projecting loops, for similar process conditions; however, it does have lower tensile strength. Further, the high bulk roving of the present invention can be produced in somewhat higher yields, in terms of yards per pound, than the high bulk roving of the aforesaid U.S. Pat. No. 4,741,151.

The method and apparatus according to the present invention for the manufacture of a high bulk roving according to the present invention employs a finger wheel that rotates in a horizontal plane to form axial direction loops in vertically moving split glass fiber strands, and a high speed spinner downstream of or surrounding the finger wheel to cause the axially looped portions of the strands to intertwine with one another and to interengage with one another and to form a twist in such axially looped strands. The spinner has an enlarged chamber portion near the outlet therefrom and a restricted outlet orifice near such spinner outlet. This arrangement causes the spinning, axially looped glass fiber strands in the spinner to "puddle" at a location near the outlet from the spinner, a factor which, in conjunction with the centrifugal forces that result from the spinning of the spinner, results in the formation of a substantial number of cross-axial loops in the axially extending loops. The cross-axial loops serve to intertwine and interengage with one another and with the axial loops to form a securely entangled, but very open, and a very high bulk or low density type of roving. Further, since the linear speed of the roving leaving the spinner is considerably less than the linear speed of the split glass fiber strand entering the spinner, the process yield, which is the ratio of the linear outlet speed to the linear inlet speed, is quite low, which indicates that the material that is passing through the process experiences a high degree of bulking during the process. To enhance the controllability of the process, the outside diameter of the finger wheel is less than the inside diameter of the spinner and the position of the finger wheel is adjustable axially relative to the spinner from a position external of the spinner to a position inside of and surrounded by the spinner.

The roving of the present invention exits from the spinner used in its manufacture through an orifice by which the roving may be impregnated with an organic sizing material, or a solution thereof, based on the desired end use of the material. As described in the aforesaid U.S. Pat. No. 4,741,151, the orifice may be constructed with an internal opening that is variable in size, for example, by constructing it in the form of an iris, to facilitate the start-up of the process and to simplify the unblocking of the process in the event of a blockage of the split glass fiber strand passing through the spinner or orifice. A glass fiber bulk strand roving according to the present invention may be used to advantage to reinforce plastic products that are produced by the pultrusion process, for example, for fabrication into oil well sucker rods, chemical grating cross members and highway dowel bars, and to reinforce shaped pultruded plastic products such as highway delineators, structural beams and other parts with small radii. Further, it is also contemplated that glass fiber bulk strand rovings according to the present invention can be used as winding materials for filament wound pipe, in compression molded laminates such as leaf springs and bumpers, in ballistic laminates, in woven fabrics for the production of large fiberglass reinforced plastic parts or as layered substitutes for woven fabrics for such parts, and in other applications requiring a lightweight material with good multiaxial strength properties.

Accordingly, it is an object of the present invention to provide a new and improved glass fiber roving product. More particularly, it is an object of the present invention to provide a glass fiber roving product which has a relatively large number of unbroken, cross-axial loops in addition to multiple axial loops, and which can be manufactured on a high throughput basis.

For a further understanding of the present invention and the objects thereof, attention is directed to the drawing figures and the following description thereof, to the best mode contemplated for carrying out the present invention and to the appended claims.

DESCRIPTION OF THE DRAWING FIGURES

BEST MODE FOR CARRYING OUT THE INVENTION

Figure 1:
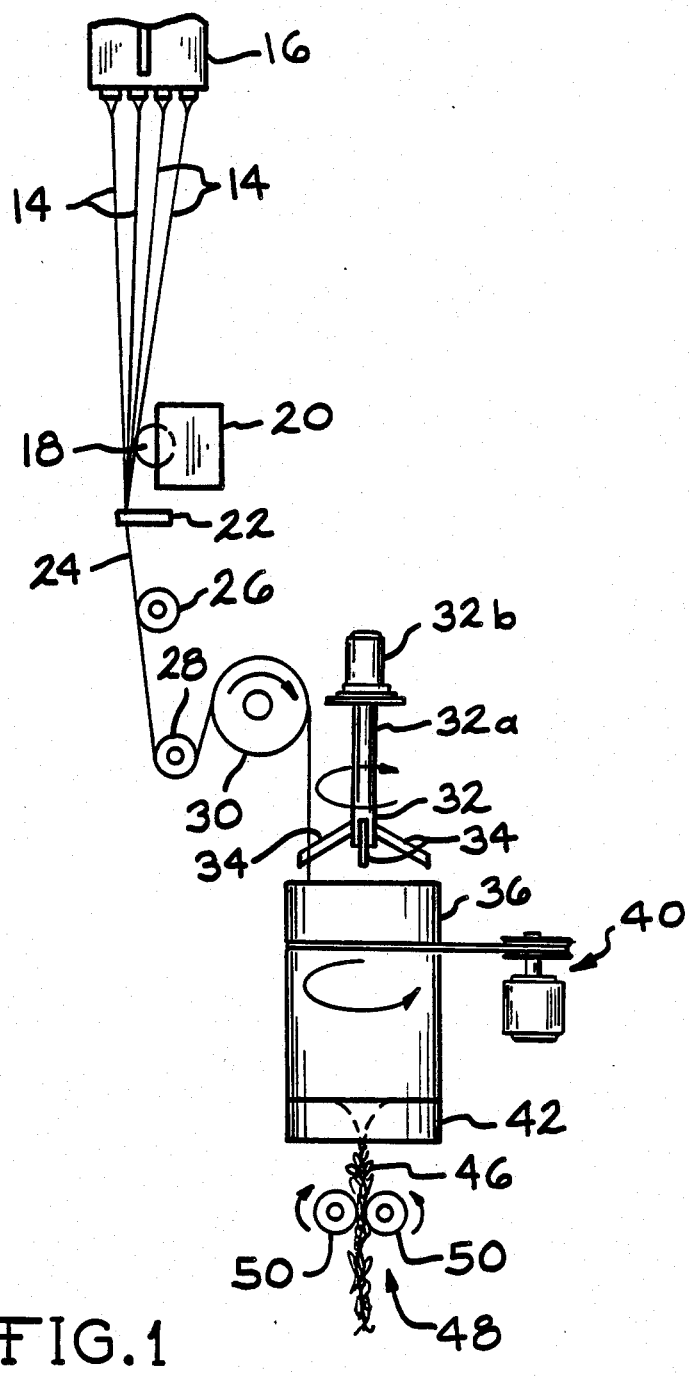
FIG. 1 is an elevational fragmentary schematic view of an apparatus for producing a glass fiber roving product according to the present invention.

As is shown in FIG. 1, glass fibers 14 are drawn continuously from a pool of molten glass, not shown, in a bushing 16, which is shown fragmentarily and which may be of conventional construction. The glass fibers 14 are wetted with a suitable primary sizing compound by passing them over a sizing applicating roller 18 that rotates through a body of liquid sizing compound which is maintained in a housing 20, in a customary manner. The primary sizing material normally is an aqueous solution which contains a coupling agent with some lubricant to facilitate the further handling of the glass fibers in the apparatus of the present invention.

The glass fibers 14, after the application of the sizing compound thereto, are passed over a splitter 22 where a multiplicity of split strands 24 are formed, each of such split strands being made up of a multiplicity of individual glass fibers 14. Preferably, each split strand 24 comprises at least 50 glass fibers, and even more preferably, each split strand comprises approximately 200 glass fibers, a number which has been found to be useful in producing a glass fiber roving product for use as a reinforcement in a plastic rod produced by the pultrusion process from a 1600 tip bushing by combining the 1600 fibers from the bushing into 8 split strands. The advance of the glass fibers 14 to the splitter 22 and the advance of the split strands 24 from the splitter 22 is accomplished by means of a driven pull wheel 30, a guide roll 26 and an idler roll 28 being provided, in succession, between the splitter 22 and the pull wheel 30. The split strands 24 leaving the pull wheel 30 pass through a rotating finger wheel 32. The finger wheel 32 has a shaft **32*a* which is rotated by a motor 32*b* and which includes a plurality of generally radially and downwardly extending fingers 34 for temporarily engaging and suspending the forward progress of the split strands 24 to form axially extending loops in the split strands. The axially looped split strands emerge from the tips of the fingers 34 of the finger wheel 32 and pass into the interior of a generally cylindrical spinner 36 which is rotated at a relatively high speed by means of a motor and belt drive assembly, which is generally identified by reference numeral 40. The axially looped split strands 24 which pass from the finger wheel 32 into the spinner 36 are caused to adhere to the inside surface 38 of the spinner 36 by virtue of the centrifugal force imparted to such axially looped split strands by the rotation of the spinner 36, and, to some extent, by surface tension resulting from the sizing compound that was applied to the glass fibers 14 by the sizing applicating roller 18. Further, as noted in the aforesaid U.S. Pat. No. 4,741,151 and if need be, the upper portion of the inside surface 38 of the spinner 36 can be provided with shallow, vertically extending grooves, not shown, to ensure good initial contact between the inside surface 38 of the spinner 36 and the axially looped split strands that pass through the spinner 36, to thereby ensure the proper removal of the split strands from the finger wheel 32 by the spinner 36. The spinning of the axially looped split strands that pass through the spinner 36** causes a twist to be imparted to all of such split strands, and it causes individual split strands to be moved from side to side relative to one another to help to provide an interengaging or intertwining relationship between such split strands to help form a composite, entangled structure therebetween.

As the axially looped split strands pass from the bottom of the spinner 36 they are caused to impinge against a surface by passing them through an outlet orifice 42 whose diameter is substantially less than the diameter of the bottom of the spinner. For example, the inside diameter of the spinner 36 may be three and three-fourths inches (3.75 in.) while the inside diameter of the outlet orifice may be one-half inch (0.5 in.). The outlet orifice 42 is positioned very close to the bottom of the spinner and it may be provided with interior passages 44 for the application of a secondary sizing compound to the product, now in the form of a roving 46, which passes therefrom. The secondary sizing compound is, typically, a binder, and this binder can be any of various known types depending on the desired end use for the roving 46, as is known in the art. The speed of advance of the axially looped split strands passing from the bottom of the spinner is controlled, in relationship to the number of such loops, by controlling the linear tip speed of the driven pull wheel 30 in relationship to the rotational speed of the finger wheel 32 and the number of fingers 34 of the finger wheel, so that the axial length of each of the axially extending loops is greater than the distance between the tips of the fingers and the restriction at the bottom or outlet from the spinner 36.

The relationship between the length of the axially extending loops, as described, and the restriction at the outlet from the spinner 36 in the form of the outlet orifice 42, causes the axially looped split strands that pass through the spinner 36 to puddle up in a mass at the bottom of the spinner 36. While the axially looped splits are in this spinning mass, portions of individual loops are caused to further loop outwardly in a cross-axial direction by virtue of the centrifugal force that such axially looped split strands experience in the spinner 36, especially while they are in the puddled up mass at the bottom where such axially looped splits are experiencing no appreciable forward axial motion, and these cross-axial loops further interengage or intertwine with one another and with other axially extending loops to further help to form an entangled, composite structure in the form of the roving 46 out of all of the axially looped split strands that enter the spinner 36.

The roving 46 exits from the spinner 36 under the influence of the pull roll assembly 48 which is made up of counterrotating pull rolls 50. From the pull roll assembly 48 the roving 46 passes to equipment, not shown, for further processing of the roving 46, for example, to equipment for drying and packaging the roving 46.

In the operation of the process and apparatus of the present invention, one of the important process variables is the bulking factor (BF) which is determined by the number of split strands (N), the turn down ratio of the system (TDR) and the loop formation ratio of the product (LFR) according to the following formula:

$$BF = N \times TDR \times LFR$$

In this formula, the turn down ratio (TDR) is equal to the pull wheel lineal speed divided by the pull roll lineal speed, assuming no slippage, or in other words, the input yardage per unit of time divided by the output yardage per unit of time, and the loop formation ratio (LFR) is equal to the theoretical amount of glass in the cross-axial direction divided by the theoretical amount of glass in the axial direction. This loop formation ratio can be determined by the pull wheel lineal speed, in feet per minute (PWS), the finger wheel tip speed, in feet per minute (FWS), the number of fingers in the finger wheel (NF), and the longitudinal distance, in feet, from the tips of the fingers of the finger wheel to the bottom of the spinner (D) according to the following formula:

$$LRF = \frac{\frac{PWS}{FWS \times NP} - 2D}{2D}$$

As is clear from the foregoing formulae, the distance D from the tips of the fingers 34 of the finger wheel 32 to the bottom of the spinner 36 is an important variable in the determination of the loop formation ratio LFR of the system and, thus, in the determination of the bulking factor BF of the system. In the system of the aforesaid U.S. Pat. No. 4,741,151, D, of necessity, is slightly greater than the axial length of the spinner, since the finger wheel is such system is not capable of passing into the interior of the spinner due to the fact that its tip diameter exceeds the diameter of the inside of the spinner and, further, die to the non-aligned relationship between the vertical axes of the finger wheel and the spinner.

Figure 2:
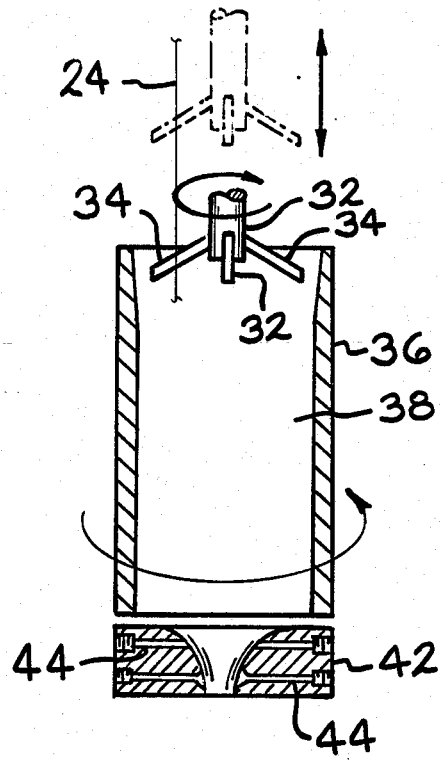
FIG. 2, is an elevational view, partly in section and at an enlarged scale, of a portion of the apparatus illustrated in FIG. 1.
Figure 3:
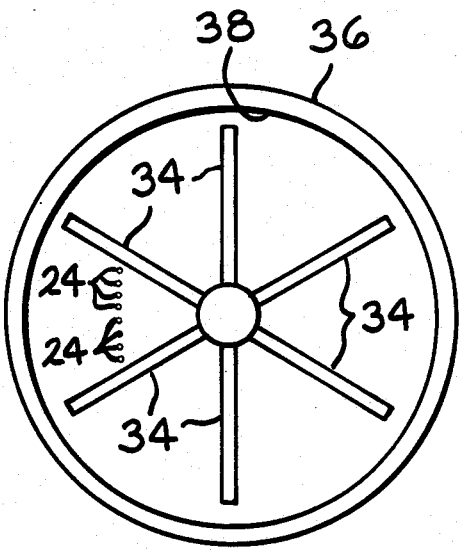
FIG. 3 is a fragmentary plan view, at an enlarged scale, of a portion of the apparatus illustrated in FIG. 1.

In the present invention, the finger wheel 32 is positioned in axial alignment with the spinner 36 and the circle which is defined by the tips of the fingers 34 of the finger wheel 32 has a diameter that is maintained at a value that is at least slightly less than that of the inside surface 38 of the spinner 36, as is shown in solid line in FIG. 2, thus permitting the tips of the fingers 34 of the finger wheel 32 to be positioned within the spinner and the achievement of D values less than the axial length of the spinner 36.

In an illustrative example, involving the use of a spinner 36 with an inside diameter of three and three-fourths inches (3.75 in.), the finger wheel 32 is axially aligned with the spinner 36 and is made up of a one-half inch (0.5 in.) diameter metal rod with six (6) arcuately evenly spaced fingers 34 extending downwardly therefrom at an angle of thirty degrees (30°) from a plane transversely of the rod, each such finger having a length of one and three-fourths inch (1.75 in.), so that the tips of such fingers 34 define a circle with a diameter of three and one-half inches (3.5 in.). Of course, it is contemplated that it is possible to use a spinner with an inside diameter substantially greater then the tip diameter of the finger wheel, in which case it would be possible to position the finger wheel on an axis that is spaced away from the axis of the spinner.

THE WAY IN WHICH THE INVENTION IS CAPABLE OF EXPLOITATION IN INDUSTRY

The bulk strand roving product of the present invention is capable of being produced in a wide variety of sizes and degrees of bulkiness by means of the method and apparatus of the present invention and, thus, is useful for many product reinforcing applications that previously utilized various types of spun roving products. Specifically, it is contemplated that such bulk strand roving products can be produced from standard glass fiber strands from G through M in filament diameter (9.14 μm through 15.80 μm) and in yields from 110-5 yds/lb. Further, such products can be produced with a very open structure which, in the high yield range, show a tendency to draft or they can be produced in a very tightly twisted structure. They can be made with axial loops of varying length, the calculated length of each of such axial loops varying from 6–32 inches, with a preferred length of approximately 10–15 inches and with cross-axial loops of varying diameter and varying mass content in relationship to the mass of the axial loops. The twist imparted to such bulk strand roving product can be in the range of 0.2–1.0 turns per inch. Additionally, since the process for the production of such bulk strand roving product as described is compatible with conventional glass fiber production processes, it can be employed using the output of a commercial size high throughput bushing, for example, a bushing having 3200 tips with a production rate of up to approximately 150 lbs./hour.

Various modifications of the above-described embodiments of the invention will be apparent to those skilled in the art, and it is to be understood that such modifications can be made without departing from the scope of the invention, if they are within the spirit and the tenor of the accompanying claims.

What is claimed is:

1. In a method of forming a roving from a plurality of fibers, the roving having axially extending loops and a relatively large number of unbroken cross-axially extending loops formed in the axially extending loops and at least partly extending outwardly from the axially extending loops, the axially extending loops and the cross-axially extending loops being interengaged and intertwined with one another, the roving having a relatively high bulk, said method comprising the steps of:

providing a plurality of fibers;

combining said plurality of fibers into a plurality of strands, each of said strands comprising more than one of said fibers;

providing a spinner having an inside surface defining a passage with an inlet, an outlet and a central axis extending between said inlet and said outlet;

providing a wheel with a plurality of fingers projecting outwardly therefrom and a central axis, each of said fingers having a tip;

rotating said wheel about said cental axis;

advancing said plurality of strands in a direction that extends axially of said plurality of strands toward and between the fingers of said wheel as said wheel rotates about said central axis;

providing an orifice adjacent said outlet of said passage of said spinner, said orifice having an axis that is generally parallel to said axis of said passage of said spinner, the size of said orifice in a plane extending transversely of said axis of said orifice being very small relative to the size of said passage in a plane extending transversely of said passage;

rotating said spinner about said central axis of said passage;

advancing said plurality of strands with said plurality of loops through said passage of said spinner from the tips of said plurality of fingers to said outlet to thereby twist said plurality of strands with said plurality of loops and form a mass of said plurality of strands with said plurality of loops in said spinner adjacent said outlet of said passage, said mass having no appreciable velocity in a direction extending axially of said plurality of strands with said plurality of loops to form a second plurality of loops in said plurality of strands with said plurality of loops, said second plurality of loops extending crosswise of said plurality of strands with said plurality of loops to interengage and intertwine with said plurality of strands with said plurality of loops and other loops in said second plurality of loops; and withdrawing said plurality of strands with said plurality of loops and said second plurality of loops from said mass in said spinner through said orifice;

the improvement wherein the tip of said each of said plurality of fingers is positioned within said passage of said spinner between said inlet and said outlet.

2. A method according to claim 1 and comprising a further improvement wherein said central axis of said wheel with a plurality of fingers extends generally vertically, and wherein said central axis of said spinner is aligned with said central axis of said wheel with a plurality of fingers.

3. A method according to claim 2 and comprising a further improvement wherein said plurality of strands with said plurality of loops and said second plurality of loops that is withdrawn from said mass in said spinner through said orifice has a yield that is in the range of approximately 110 to 130 yards per pound.

4. In apparatus for forming a roving from a plurality of fibers, the roving having generally axially extending loops, a relatively large number of unbroken, cross-axially extending loops formed in the axially extending loops and at least partly extending outwardly from the axially extending loops, the axially extending loops and the cross-axially extending loops being interengaged and intertwined with one another, the roving having a relatively high bulk, said apparatus comprising, in combination:

means for providing a plurality of fibers;

means for combining said plurality of fibers into a plurality of strands, each of said strands comprising more than one of said fibers, the number of strands in said plurality of strands being less than the number of fibers in said plurality of fibers;

a spinner having an inside surface defining a passage having an inlet, an outlet, and a central axis extending between said inlet and said outlet;

a wheel having a plurality of fingers projecting outwardly therefrom and a central axis, each of said plurality of fingers having a tip;

means for rotating said spinner and said plurality of fingers about said central axis;

means for advancing said plurality of strands in a direction that extends axially of said plurality of strands and between said fingers of said wheel as said wheel rotates about said central axis to form a plurality of axially extending loops in said plurality of strands in said passage of said spinner;

orifice means defining an orifice, said orifice means being disposed adjacent said outlet of said passage of said spinner, said orifice means having an axis that is generally parallel to said axis of said interior passage of said spinner, the size of said orifice of said orifice means in a plane extending transversely of said axis of said orifice being very small relative to the size of said passage in a plane extending transversely of said passage; and means for rotating said spinner;

the improvement wherein each of said plurality of fingers define a closed geometric figure which is capable of being positioned within said spinner between said inlet and said outlet.

5. Apparatus according to claim 4 and comprising the further improvement wherein said tips of said plurality of fingers are positioned within said interior of said spinner between said inlet and said outlet.

6. Apparatus according to claim 4 and comprising the further improvement wherein said central axis of said spinner and said central axis of said wheel are in alignment.

* * * * *